US006149553A

United States Patent [19]

Antoszewski

[11] Patent Number: 6,149,553

[45] Date of Patent: Nov. 21, 2000

[54] MARTIAL ARTS BOARD HOLDING DEVICE

[76] Inventor: Nicholas Antoszewski, 7056 Bapst, Holland, Ohio 43528

[21] Appl. No.: 09/164,181

[22] Filed: Sep. 30, 1998

[51] Int. Cl.[7] ..... A63B 69/34

[52] U.S. Cl. ..... 482/83; 482/88; 482/87; 434/247

[58] Field of Search ..... 482/83–90, 148; 434/247; 428/58–60

[56] References Cited

U.S. PATENT DOCUMENTS

| | | |
|---|---|---|
| D. 357,516 | 4/1995 | Ohland . |
| 4,757,989 | 7/1988 | Bauer, Jr. . |
| 4,883,635 | 11/1989 | Goradesky . |
| 4,973,045 | 11/1990 | Heberer . |
| 5,232,368 | 8/1993 | Morgia . |
| 5,362,829 | 11/1994 | Holt . |
| 5,415,371 | 5/1995 | Kirchner . |
| 5,665,035 | 9/1997 | Tumminia . |

*Primary Examiner*—Jerome Donnelly
*Attorney, Agent, or Firm*—MacMillan, Sobanski & Todd, LLC

[57] ABSTRACT

A portable, free-standing martial arts board holding device. The device includes a backboard and a pair of elongate members on which boards to be struck and broken by a practitioner are supported against spaced from the backboard. An extension member permits additional boards to be held on the device. The elongate members includes holes to allow tubular members to pass therethrough. A wide range of desired heights of the backboard can be selected by the practitioner by passing the backboard through the holes. In addition, the backboard can be rotated such that the grains of the boards runs either generally vertically or generally horizontally to receive kicks and other blows

16 Claims, 4 Drawing Sheets

MARTIAL ARTS BOARD HOLDING DEVICE

BACKGROUND OF THE INVENTION

This invention relates in general to a device for holding a board, and more particularly to a martial arts device for rigidly holding one or more boards to receive a karate blow or the like.

The standardized karate board is a white pine wood board that is nominally about 12 inches by 12 inches by 1 inch thick. The board is supported on opposite parallel sides with the wood grain running parallel to the sides that are held. Often in the practice of the martial arts it is desired to break boards with kicks and other blows. Typically, such boards must be rigidly held along their marginal edges either by the hands of a person other than the one breaking the board, or by a board holding device.

In the face of sharp blows, it is difficult to hold the boards rigidly by hand, especially at any angle other than that where the face of the board is vertical. It is also difficult to hold boards rigidly by hand at different heights within a wide range of possible heights. Moreover, although it is sometimes desired to break a group of boards stacked together, it is difficult to hold more than a very few boards at one time because the cumulative thickness renders the stack of boards difficult to grip firmly.

Manually holding the stack of boards can result in injury to the persons holding the boards as a result of one or more factors, such as the inaccuracy of the practitioner, the shattering of the boards upon being struck, fingers of the holding persons on the striking surface of the board, broken boards twisting or slipping out of the holder's grasps, etc. In addition, the skin of the hands may be pinched between the boards, or the holder may be injured by the forcefully moving hand, arm, foot or head of the striker, or by flying pieces of the broken board, or by the force of impact itself.

Mechanical holders for a stack of karate boards that are adapted for mounting on a floor, wall or post have also been suggested. For example, a board holder with hand grips is marketed by Black Belt Products, Inc. as the "Break Master." The device consists of two separate handgrips that are adapted for attachment to the edges of the board, so that it is no longer necessary to hold the board directly in order to resist the impact of a blow. The device can be strapped to a bag or mounted to a wall.

Such mechanical holders are limited as to the orientation at which the practitioner can strike the boards. Also, such mechanical holders usually have metal parts extending in front of and/or alongside the stack that may injure the practitioner should he miss the center of the stack and strike the part. In addition, such mechanical holders are limited as to the number of boards that can be struck. The danger of injury increases with the number of boards that are held, since greater and greater force and accuracy are required to break more and more boards. Finally, such mechanical holders do not allow the practitioner to easily adjust the height of the holder to the desired height.

Nevertheless, it is still preferred by practitioners to strike the boards with either horizontal movement or vertical movement. Further, it is preferred that the kicks and other blows be delivered at a wide variety of heights. Thus, it is desirable that the boards be able to be held at various heights for reception of either horizontal or vertical strikes.

SUMMARY OF THE INVENTION

This invention relates to a device for holding boards to be struck by a martial arts practitioner.

One object of the invention is a martial arts board holding device that is adjustable to hold boards at a variety of different heights.

Another object of the invention is a martial arts board holding device that rigidly holds one or more boards so that the grain of the boards runs either generally vertically or generally horizontally to receive such kicks and other blows.

Yet another object of the invention is a martial arts board holding device that is portable.

Still yet another object of the invention is to provide a martial arts board holding device that can be used by leaning the device against a generally vertical structure without the need to fixedly attach the device to the structure.

Yet another object of the invention is a martial arts board holding device that is adjustable to hold a desired number of boards.

To accomplish these and other objectives, the martial arts board holding device comprises a backboard, a first and second elongated board holding members spaced vertically on and extending from the backboard, each member having an outer surface for resting at least one board therefrom, each member having and inward and opposing faces, the inward faces being generally parallel and defining a board holding space therebetween, and a pair of support gussets secured to the backboard and the opposing faces of a respective one of the board holding members. The backboard is capable of being orientated along either a horizontal axis and a vertical axis of the backboard, thereby permitting the practitioner to strike the holding boards in accordance with the orientation of the backboard.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
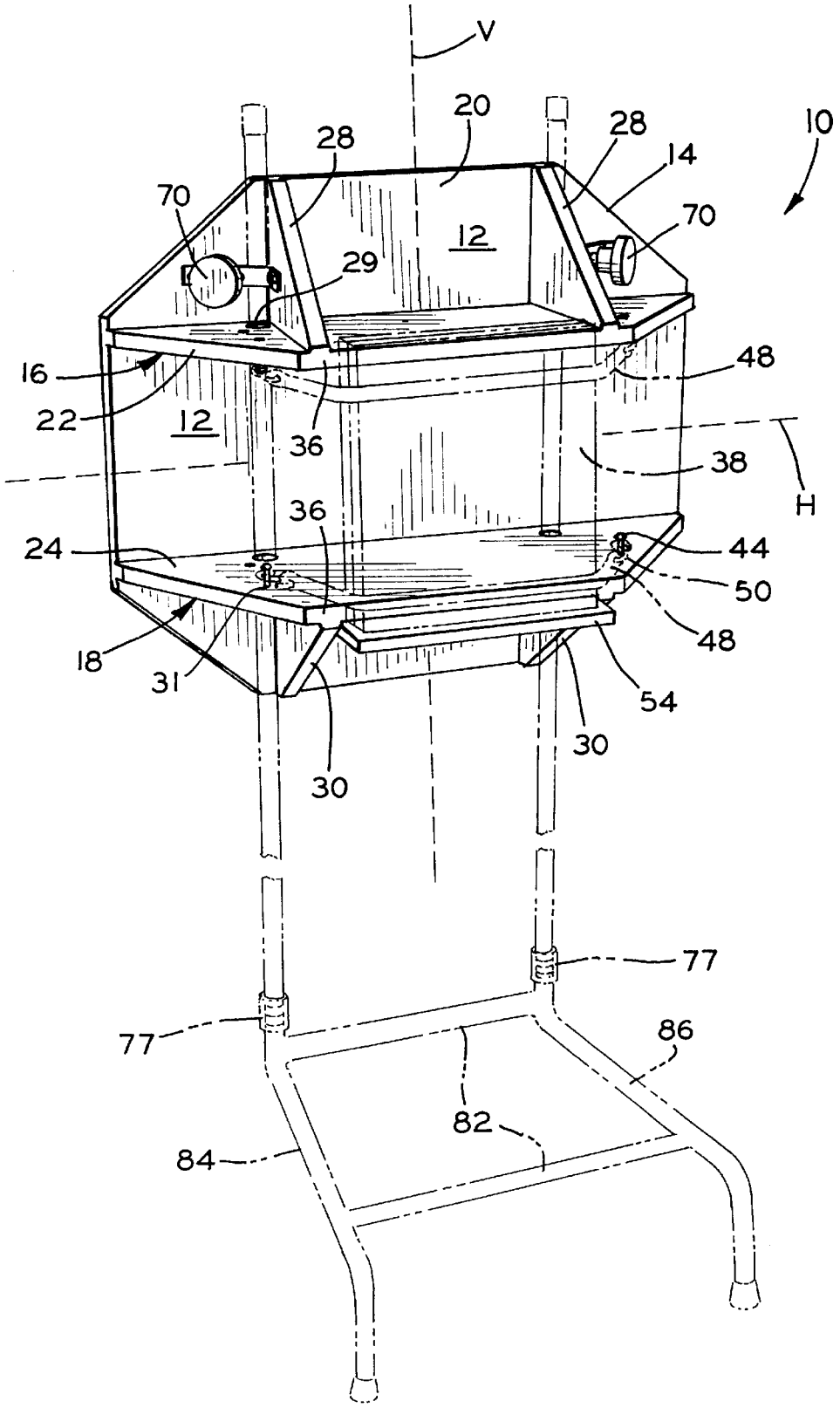
FIG. 1 is a side perspective view of martial arts board holding device according to a preferred embodiment of the invention.
Figure 2:
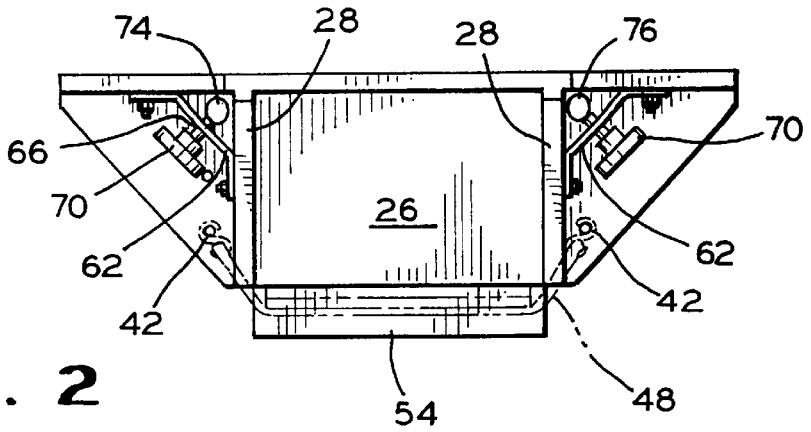
FIG. 2 is a top view of the board holding device shown in FIG. 1.
Figure 3:
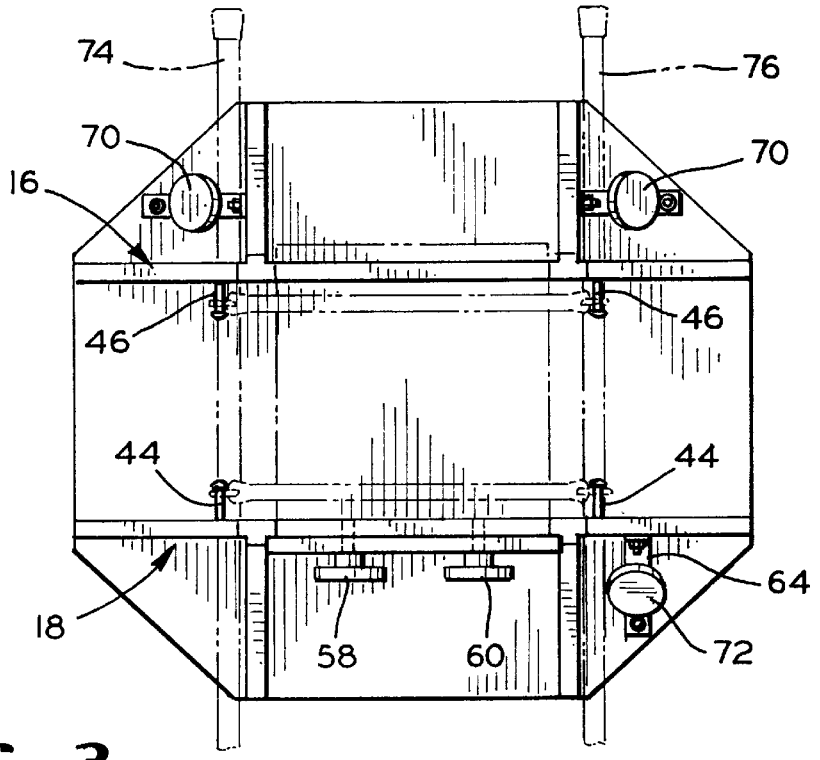
FIG. 3 is a front view of the board holding device shown in FIG. 1.
Figure 4:
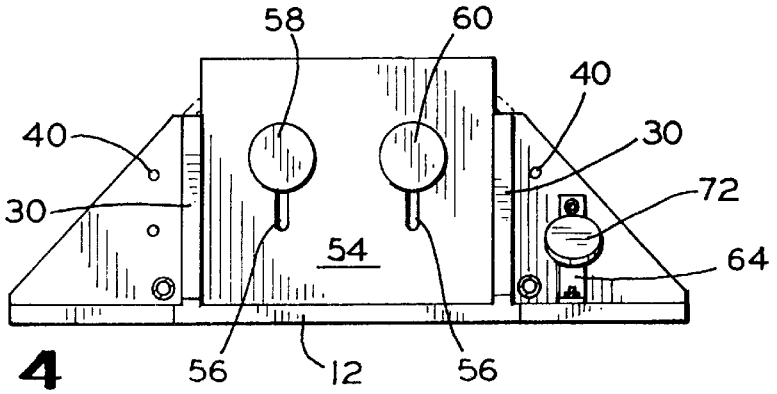
FIG. 4 is a bottom view of the board holding device shown in FIG. 1.
Figure 5:
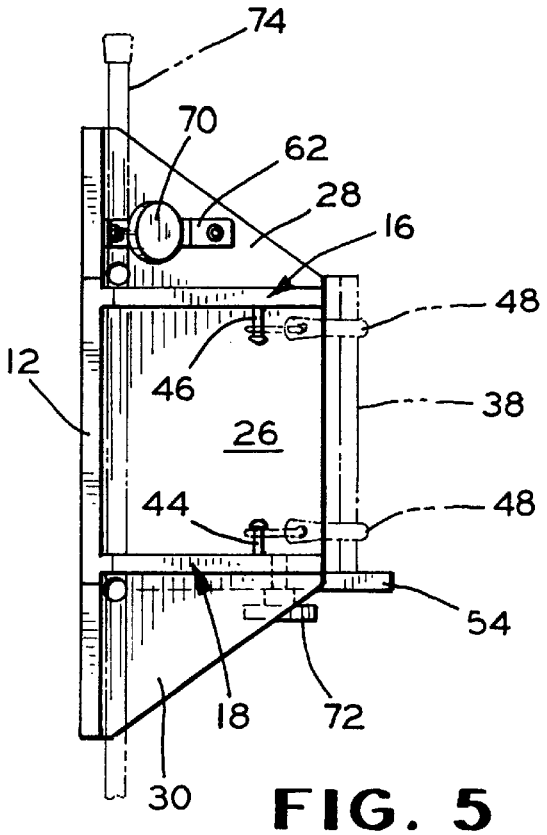
FIG. 5 is a left side view of the board holding device shown in FIG. 1.
Figure 6:
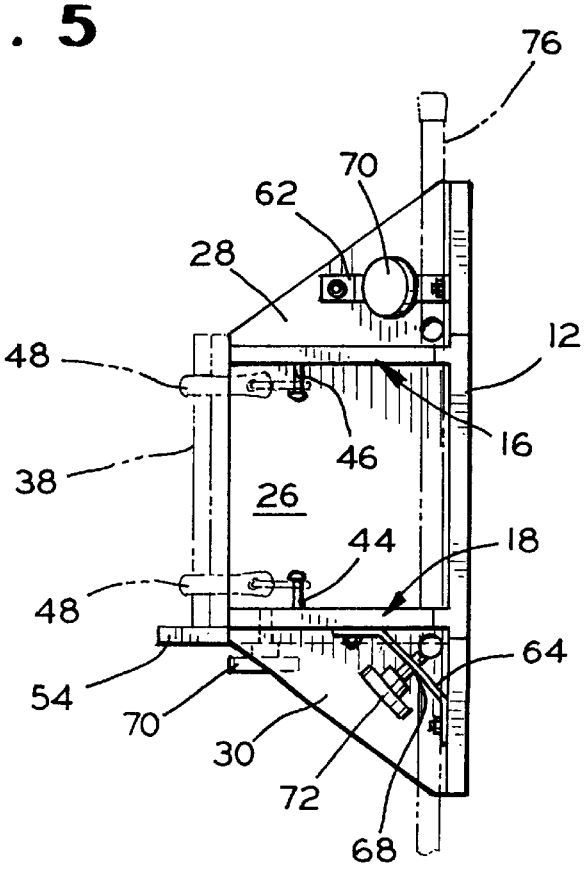
FIG. 6 is a right side view of the board holding device shown in FIG. 1.

Referring now to the drawings, there is illustrated in FIGS. 1–6 a holding device, shown generally at 10, particularly useful in martial arts training according to a preferred embodiment of the invention. The device 10 includes a backboard 12. The backboard 12 is preferably made of a suitable non-breakable material, such as wood, plastic, fiberglass, and the like. Preferably, the backboard 12 has a width of approximately 24–30 inches and a height of 24–30 inches such that it has a surface area adequately large to be able to sufficiently distribute any forces produced by the practitioner on the backboard 12. Each corner may be angled at 14 so that the backboard 12 is generally octagon in shape. However, it should be realized that the backboard 12 may be formed in any desired shape, polygonal or otherwise.

The device 10 further includes a pair of elongated members 16, 18 that are secured to and extend vertically from the front surface 20 of the backboard 12. The members 16, 18 may be secured to the backboard 12 by using means well known in the art, such as gluing, screwing, and the like. The members 16, 18 include inward and opposing faces 22, 24 that are generally parallel to each other. The inward faces 22 of each member 16, 18 define a board holding space 26 therebetween. Two pairs of support gussets 28, 30 are secured to the backboard 12 and the outer surfaces 32, 34 of the elongate members 16, 18. Each member also includes a pair of holes 29, 31 preferably located adjacent each pair of support gussets 28, 30. The purpose of the holes 29, 31 is described below. The elongate members 16, 18 and support gussets 28, 30 are preferably made of a suitable non-breakable material, such as wood, plastic, fiberglass, and the like.

Means are provided to hold boards in the space between and against the front surface 36, 37 of the elongate members 16, 18. The board holding means may use any well known means in the art for holding the boards 38 to the backboard 12. For example, holes 40, 42 may be drilled through each member 16, 18 and threaded inserts 44, 46 such as a bolt, post, and the like, may be secured within the holes 40, 42, respectively. Then, a band or strap 48, preferably made of stretchable, elastomeric material, such as EDPM, and the like, having a hook 50 at each end thereof, may be wrapped around the boards to secure the boards 38 in the board holding space 26 against the front surface 36, 37 of each member 16, 18. It should be noted that the strap 48 may be in any suitable length so as to be able to wrap around the desired number of boards 38.

The device 10 also includes an extension member 54 slidably mounted to one of the elongated members 16, 18 for supporting the desired number of boards 38 to be broken by the practitioner. The extension member 54 is preferably made of a suitable non-breakable material, such as wood, plastic, fiberglass, and the like. Preferably, the extension member 54 includes a pair of openings or slots 56 for receiving a pair of knobbed screws 58, 60 for securing the extension member 54 to one of the elongated members 16, 18 at the desired location. At times when the practitioner wants to mount additional boards 38 to the device 10, the extension member 54 can by removed by completely unscrewing the knobbed screws 58, 60 and then slidably mounting a different extension member 54 having a greater length than the previous extension member 54. In this manner, the device 10 can accommodate any desired number of boards 38, unlike conventional board holding devices.

Means are also provided to support the backboard 12 against a vertical surface (not shown) and to adjust the height of the backboard 12 to any desired height. In the preferred embodiment, the supporting and adjusting means includes a plurality of brackets 62, 64. A pair of brackets 62 is secured to the front surface 20 and to the respective support gusset 28, 30. Another bracket 64 is secured to the front surface 20 of the backboard 12 and one of the elongate members 16, 18. Each bracket 62, 64 includes a threaded opening 66, 68 for receiving knobbed screws 70, 72, respectively. The brackets 62, 64 are positioned adjacent the holes 29, 31 through the elongated members 16, 18. It should be appreciated that the device 10 is not limited to the number of brackets 62, 64 and that the invention can be practiced with any sufficient number of brackets 62, 64.

A pair of tubular members 74, 76 can pass through the holes 29, 31 to slidably mount the backboard 12 to the tubular members 74, 76. Preferably, the tubular members 74, 76 are made of a non-flexible material, such as metal or other suitable material. For example, tubular members 74, 76 may be metal piping. The knobbed screws 70, 72 can then be tightened to secure the backboard 12 to the desired height.

Figure 7:
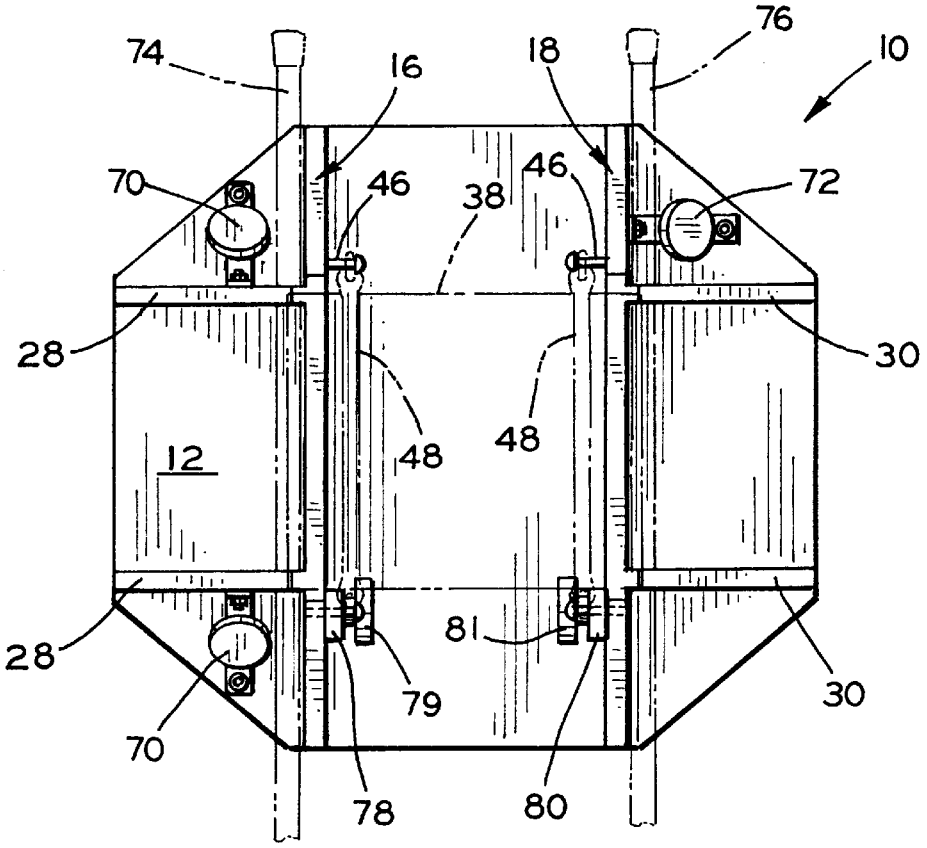
FIG. 7 is a front view of the board holding device when rotated ninety degrees so that the boards are running along the vertical axis, V, according to the preferred embodiment of the invention.
Figure 8:
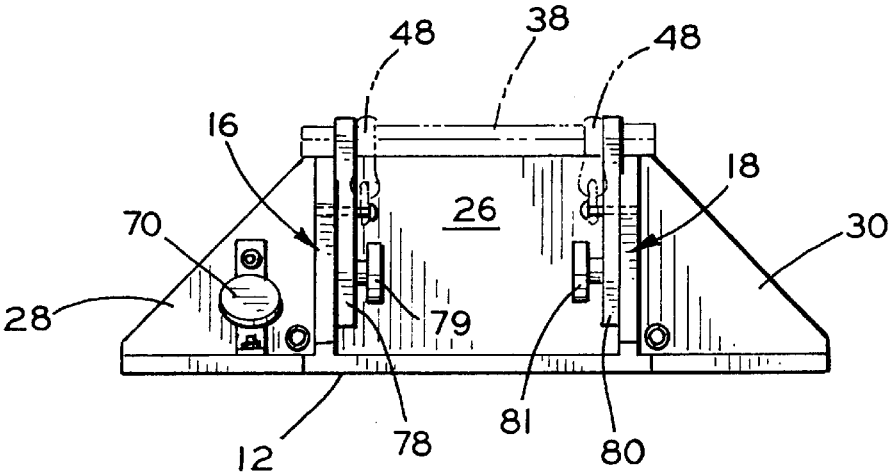
FIG. 8 is a bottom view of the board holding device shown in FIG. 7.

As shown in FIGS. 1–6, the device 10 is orientated such that the board holding space 26 allows the practitioner to strike the boards 38 along the horizontal axis, H. One of the important feature of the invention is that the device 10 can also be oriented along the vertical axis, V, to allow the practitioner to strike the boards 38 along the vertical axis, V. As shown in FIGS. 7 and 8, this can be accomplished by rotating the backboard 12 in the clockwise or counterclockwise direction ninety (90) degrees and slidably mounting the backboard 12 to the tubular members 74, 76. A pair of extension members 78, 80 can be used to support the boards 38 from underneath in a similar manner as the extension member 54. In addition, each member 78, 80 may be slidably mounted to each member 16, 18, respectively. In this manner, the extension length of each member 78, 80 can be selected by the practitioner in order for the device 10 to accommodate a desired number of boards 38. A pair of knobbed screws 79, 81 may be used to tighten each 78, 80 against the members 16, 18 to secure the device 10 at the desired height.

The tubular member 74, 76 may be removably attached to a base portion, shown generally at 82 by screwing the tubular members 74, 76 into a threaded coupling 77. This feature enables the device 10 to be easily assembled and disassembled when transporting the device 10, for example, in a trunk of a car. The base portion 82 includes a pair of tubular members 84, 86 that are preferably made of the same material as the tubular members 74, 78. The base portion 82 may include one or more support members 82 for maintaining the tubular members 74, 76 and the tubular members 84, 86 in a generally parallel relationship. Preferably, the tubular members 84, 86 are curved outwardly, that is, away from the backboard 12, and away from each other so as to provide a wide base for enabling the device 10 to be leaned against a generally vertical structure (not shown), such as a wall, post, tree, and the like, without the need for fixedly attaching the device 10 to the structure, unlike conventional board holding devices.

As described above, the invention has many distinct advantages over conventional board holding devices. For example, the invention can be oriented in both the horizontal and vertical orientations to allow the practitioner to strike the boards horizontally or vertically, unlike conventional board holding devices. In addition, the invention is much sturdier and safer than the manual holding of boards. In manual holding, the shock immediately goes to the holders' arms when the boards are struck, whereas, in the invention the shock is absorbed by the invention. Further, the invention can easily be adjusted to any desired height by simply sliding the backboard to the desired height and tightening the appropriate knobbed screws.

In accordance with the provisions of the patent statutes, the principle and mode of operation of this invention have been explained and illustrated in its preferred embodiment.

However, it must be understood that this invention may be practiced otherwise than as specifically explained and illustrated without departing from its spirit or scope.

What is claimed is:

1. An apparatus for supporting a board to be struck by a martial arts practitioner comprising:

a backboard;

first and second members secured to said backboard, said first member having a first hole formed therethrough in a first direction, said second member having a second hole formed therethrough in a second direction different from said first direction;

a base including a member, said member being insertable through said first hole for supporting said backboard thereon in a first orientation relative to said base, said member being insertable through said second hole for supporting said backboard thereon in a second orientation relative to said base; and a board holding structure secured to said backboard for supporting a board thereon.

2. The apparatus defined in claim 1 wherein said first member has a plurality of first holes formed therethrough in said first direction, and wherein said base includes a plurality of members that are insertable through said plurality of first holes for supporting said backboard thereon in said first orientation relative to said base.

3. The apparatus defined in claim 1 wherein said second member has a plurality of second holes formed therethrough in said second direction, and wherein said base includes a plurality of members that are insertable through said plurality of second holes for supporting said backboard thereon in said second orientation relative to said base.

4. The apparatus defined in claim 1 wherein said first member has a plurality of first holes formed therethrough in said first direction and said second member has a plurality of second holes formed therethrough in said second direction, and wherein said base includes a plurality of members that are insertable through said plurality of first holes for supporting said backboard thereon in said first orientation relative to said base and are insertable through said plurality of second holes for supporting said backboard thereon in said second orientation relative to said base.

5. The apparatus of defined in claim 1 wherein said first member includes a pair of spaced apart first members, each of said first members having a first hole formed therethrough in a first direction, said member of said base being insertable through each of said first holes for supporting said backboard thereon in a first orientation relative to said base.

6. The apparatus of defined in claim 1 wherein said second member includes a pair of spaced apart second members, each of said second members having a second hole formed therethrough in a second direction, said member of said base being insertable through each of said second holes for supporting said backboard thereon in a second orientation relative to said base.

7. The apparatus defined in claim 1 wherein said first member includes a pair of spaced apart first members, each of said first members having a first hole formed therethrough in a first direction, and said second member includes a pair of spaced apart second members, each of said second members having a second hole formed therethrough in a second direction, said member of base being insertable through each of said first holes for supporting said backboard thereon in a first orientation relative to said base and being insertable through each of said second holes for supporting said backboard thereon in a second orientation relative to said base.

8. The apparatus defined in claim 1 further including means for retaining said backboard in a predetermined position relative to said base.

9. The apparatus defined in claim 8 wherein said means for retaining said backboard in a predetermined position relative to said base includes a threaded fastener supported on said backboard and selectively movable into frictional engagement with said member of said base.

10. The apparatus defined in claim 8 wherein said means for retaining said backboard in a predetermined position relative to said base includes a first threaded fastener supported on said backboard and selectively movable into frictional engagement with said member of said base when said backboard is in said first orientation relative to said base, and a second threaded fastener supported on said backboard and selectively movably into frictional engagement with said member of said base when said backboard is in said second orientation relative to said base.

11. The apparatus defined in claim 1 wherein said board holding structure is provided on one of said first and second members.

12. The apparatus defined in claim 1 wherein said board holding structure includes a strap.

13. The apparatus defined in claim 12 wherein said strap is formed from an elastomeric material.

14. The apparatus defined in claim 1 wherein said board holding structure includes an extension member slidably supported on one of said first and second members.

15. The apparatus defined in claim 14 further including means for retaining said extension member in a predetermined position relative to said one of said first and second members.

16. The apparatus defined claim 15 wherein said means for retaining said extension member in a predetermined position relative to said one of said first and second members includes a threaded fastener supported on said one of said first and second members and selectively movable into frictional engagement with said extension member.

* * * * *